US008252210B2

(12) United States Patent
Zak et al.

(10) Patent No.: US 8,252,210 B2
(45) Date of Patent: Aug. 28, 2012

(54) METHOD AND DEVICE FOR EXPLOSION FORMING

(75) Inventors: Alexander Zak, Moedling (AT); Andreas Stranz, Reichenau (AT)

(73) Assignee: Cosma Engineering Europe AG, Oberwaltersdorf (AT)

( * ) Notice: Subject to any disclaimer, the term of this patent is extended or adjusted under 35 U.S.C. 154(b) by 195 days.

(21) Appl. No.: 12/377,190

(22) PCT Filed: May 8, 2007

(86) PCT No.: PCT/EP2007/004055

§ 371 (c)(1),
(2), (4) Date: Feb. 11, 2009

(87) PCT Pub. No.: WO2008/017332

PCT Pub. Date: Feb. 14, 2008

(65) Prior Publication Data

US 2010/0207287 A1 Aug. 19, 2010

(30) Foreign Application Priority Data

Aug. 11, 2006 (DE) ..... 10 2006 037 742

(51) Int. Cl.
*C06B 21/00* (2006.01)

(52) U.S. Cl. ..... 264/3.1; 264/482; 425/1

(58) Field of Classification Search ..... 264/3.1, 264/482; 425/1
See application file for complete search history.

(56) References Cited

U.S. PATENT DOCUMENTS

| | | | | |
|---|---|---|---|---|
| 1,566,127 | A * | 12/1925 | Rundquist | 362/326 |
| 392,635 | A | 5/1933 | Powers | |
| 3,160,949 | A | 12/1964 | Bussey et al. | |
| 3,195,334 | A * | 7/1965 | Filler | 72/56 |
| 3,252,312 | A | 5/1966 | Maier | |
| 3,342,048 | A | 9/1967 | Johnson et al. | |
| 3,371,404 | A * | 3/1968 | Lemelson | 228/107 |
| 3,600,921 | A | 8/1971 | Schwarz | |
| 3,640,110 | A | 2/1972 | Inoue | |
| 3,654,788 | A | 4/1972 | Kimura | |

(Continued)

FOREIGN PATENT DOCUMENTS

AT 248838 8/1966

(Continued)

OTHER PUBLICATIONS

Translation of FR2424510A obtained from Google Translate, the reference dated Dec. 1979.*

(Continued)

*Primary Examiner* — Joseph Del Sole
*Assistant Examiner* — David N Brown, II
(74) *Attorney, Agent, or Firm* — Dickinson Wright PLLC

(57) ABSTRACT

With the invention, a method and a device for explosive forming of work pieces, in which at least one work piece is arranged in at least one die and there deformed by means of an explosive to be ignited, is to be improved, in that an ignition mechanism that is technically easy to handle is produced with the shortest possible setup times, which permits the most precise possible ignition of the explosive with time-repeatable accuracy. This task is solved by a method and device, in which at least one work piece is arranged in at least one die and deformed there by means of an explosive being ignited, in which the explosive is ignited by means of at least one energy beam.

36 Claims, 4 Drawing Sheets

U.S. PATENT DOCUMENTS

| | | | | | |
|---|---|---|---|---|---|
| 3,661,004 | A | * | 5/1972 | Lee et al. | 72/56 |
| 1,280,451 | A | | 7/1972 | Hagen | |
| 3,737,975 | A | | 6/1973 | McKinnon, Jr. | |
| 3,742,746 | A | * | 7/1973 | Erlandson | 72/56 |
| 3,869,938 | A | * | 3/1975 | Schlotterbeck et al. | 74/567 |
| 4,187,709 | A | | 2/1980 | Legate et al. | |
| 4,471,640 | A | | 9/1984 | Kortenski et al. | |
| 4,492,104 | A | | 1/1985 | Weaver et al. | |
| 4,494,392 | A | | 1/1985 | Schroeder | |
| 4,552,742 | A | * | 11/1985 | Mayer | 423/446 |
| 4,571,800 | A | | 2/1986 | Faupell | |
| 4,702,808 | A | * | 10/1987 | Lemelson | 204/157.41 |
| 4,738,012 | A | | 4/1988 | Hughes et al. | |
| 4,788,841 | A | | 12/1988 | Calhoun et al. | |
| 4,856,311 | A | | 8/1989 | Conaway | |
| 4,904,083 | A | * | 2/1990 | Lu et al. | 356/469 |
| 5,049,330 | A | * | 9/1991 | Rebhan | 264/84 |
| 5,187,962 | A | | 2/1993 | Bilko et al. | |
| 5,220,727 | A | | 6/1993 | Hochstein | |
| 5,339,666 | A | | 8/1994 | Suzuki et al. | |
| 5,377,594 | A | | 1/1995 | Alford | |
| 5,890,698 | A | | 4/1999 | Domytrak | |
| 2006/0060601 | A1 | | 3/2006 | Kubacki et al. | |

FOREIGN PATENT DOCUMENTS

| | | | | |
|---|---|---|---|---|
| AT | 276032 | | | 11/1969 |
| AT | 371384 | | | 6/1983 |
| CH | 409831 | | | 10/1966 |
| DE | 1452667 | U | | 12/1938 |
| DE | 1218986 | | | 1/1967 |
| DE | 1235246 | B1 | | 3/1967 |
| DE | 1129562 | | | 10/1968 |
| DE | 1452665 | A1 | | 5/1969 |
| DE | 1452667 | A1 | | 5/1969 |
| DE | 1527949 | A1 | | 11/1969 |
| DE | 1801784 | A1 | | 6/1970 |
| DE | 1808942 | A1 | | 6/1970 |
| DE | 2043251 | | | 9/1970 |
| DE | 1777207 | A1 | | 4/1971 |
| DE | 1777208 | A1 | | 4/1971 |
| DE | 2043251 | | | 3/1972 |
| DE | 2059181 | A1 | | 6/1972 |
| DE | 2107460 | A1 | | 8/1972 |
| DE | 2357295 | A1 | | 5/1974 |
| DE | 2337176 | A1 | | 6/1975 |
| DE | 114231 | | | 7/1975 |
| DE | 2622317 | A1 | | 1/1977 |
| DE | 2628579 | A1 | | 12/1977 |
| DE | 2908561 | A1 | | 10/1979 |
| DE | 158364 | | | 12/1983 |
| DE | 3341488 | A1 | | 5/1984 |
| DE | 3305615 | A1 | | 8/1984 |
| DE | 217154 | A1 | | 1/1985 |
| DE | 3590248 | C2 | | 6/1986 |
| DE | 3512015 | A1 | | 10/1986 |
| DE | 260450 | A1 | | 9/1988 |
| DE | 3709181 | A1 | | 9/1988 |
| DE | 4035894 | C1 | | 1/1992 |
| DE | 4232913 | C2 | | 4/1994 |
| DE | 19536292 | | | 4/1997 |
| DE | 19638679 | A1 | | 3/1998 |
| DE | 19638688 | A1 | | 3/1998 |
| DE | 19709918 | A1 | | 9/1998 |
| DE | 19818572 | C1 | | 11/1999 |
| DE | 19852302 | A1 | | 5/2000 |
| DE | 19915383 | B4 | | 10/2000 |
| DE | 19957836 | A1 | | 6/2001 |
| DE | 10328154 | A1 | | 12/2004 |
| DE | 102005025660 | A1 | | 12/2006 |
| DE | 102006056788 | | | 12/2006 |
| DE | 102007007330 | | | 2/2007 |
| DE | 102007023669 | | | 5/2007 |
| DE | 102006008533 | A1 | | 8/2007 |
| DE | 102007036196 | | | 8/2007 |
| DE | 102006019856 | A1 | | 11/2007 |
| DE | 102006037754 | B3 | | 1/2008 |
| DE | 102008006979 | | | 1/2008 |
| DE | 102006037742 | A1 | | 2/2008 |
| DE | 102006060372 | A1 | | 6/2008 |
| EP | 0151490 | A2 | | 8/1985 |
| EP | 148459 | B1 | | 11/1987 |
| EP | 0288705 | A2 | | 11/1988 |
| EP | 00371018 | B1 | | 7/1992 |
| EP | 0592068 | A1 | | 4/1994 |
| EP | 0590262 | B1 | | 4/1996 |
| EP | 0765675 | A2 | | 4/1997 |
| EP | 0830906 | A1 | | 3/1998 |
| EP | 0830907 | A2 | | 3/1998 |
| EP | 1702695 | A2 | | 9/2006 |
| EP | 1849551 | A2 | | 10/2007 |
| FR | 1342377 | A | | 9/1963 |
| FR | 2300322 | A1 | | 2/1975 |
| FR | 2280465 | | | 2/1976 |
| FR | 7503396 | | | 9/1976 |
| FR | 2424510 | A | * | 12/1979 |
| GB | 742460 | | | 6/1952 |
| GB | 878178 | A | | 9/1961 |
| GB | 1129562 | A | | 10/1968 |
| GB | 1280451 | A | | 7/1972 |
| GB | 1419889 | | | 12/1975 |
| GB | 1436538 | | | 5/1976 |
| GB | 1501049 | A | | 2/1978 |
| GB | 1542519 | A | | 3/1979 |
| GB | 2009651 | A | | 6/1979 |
| GB | 2047147 | A | | 11/1980 |
| JP | 55-139128 | A | | 10/1980 |
| JP | 58145381 | A | | 8/1983 |
| JP | 2117728 | A | | 5/1990 |
| JP | 739958 | | | 2/1995 |
| JP | 70505176 | | | 2/1995 |
| JP | 2001054866 | A | | 2/2001 |
| JP | 2002093379 | A | | 3/2002 |
| JP | 2007-222778 | A | | 9/2007 |
| WO | 9933590 | A2 | | 7/1999 |
| WO | 0000309 | A1 | | 1/2000 |
| WO | 2004028719 | A1 | | 4/2004 |
| WO | 2006128519 | A | | 12/2006 |
| WO | WO 2006128519 | A1 | * | 12/2006 |
| WO | 2008098608 | A1 | | 8/2008 |
| WO | 2009095042 | A1 | | 8/2009 |

OTHER PUBLICATIONS

Translation of FR2424510A obtained from the esp@ce.net website, the reference dated Dec. 1979.*

* cited by examiner

METHOD AND DEVICE FOR EXPLOSION FORMING

CROSS-REFERENCE TO RELATED APPLICATIONS

This application claims priority from German Patent Application Serial No. 102006037742.7 filed on Aug. 11, 2006, entitled "Verfahren and Vorrichtung zum Explosionsumformen" (Method and Device for Explosive Forming), the disclosure of which is incorporated herein by reference for all purposes.

FIELD OF THE INVENTION

The invention concerns a method and a device for explosive forming.

BACKGROUND OF THE INVENTION

During explosive forming, a work piece is arranged in a die and deformed by ignition of an explosive, for example, a gas mixture. The explosive is generally introduced to the die, and also ignited here. Two problems are then posed. On the one hand, the die and the ignition mechanism must be suitable to initiate the explosion in targeted fashion and withstand the high loads occurring during the explosion, and, on the other hand, good forming results with the shortest possible setup times must be repeatedly achieved.

In a method known from EP 0 830 907 for forming of hollow elements, like cans, the hollow element is inserted into a die and the upper opening of the hollow element closed with a plug. An explosive gas is introduced into the cavity via a line in the plug, which is then ignited via a spark plug arranged in the plug.

In a method described in U.S. Pat. No. 3,342,048, a work piece being deformed is also arranged in a die and filled with an explosive gas mixture. Ignition occurs here by means of mercury fulminate and a heating wire or filament. Both methods are particularly suitable for individual part manufacture and have not gained acceptance in practice for mass production.

SUMMARY OF THE INVENTION

The underlying task of the invention is to improve a method, as well as device, of the generic type just mentioned, so that an ignition mechanism that is technically simple to handle is produced with short setup times, which permits the most precise possible ignition of the explosive with time-repeatable accuracy.

This task is solved according to the invention with a method for explosive forming of work pieces comprising: arranging a work piece (18) within a forming device (4) of a die (2), the forming device (4) defining a final shape of the work piece (18); charging an ignition chamber (6) of an ignition tube (5) of the die (2) with an explosive (7), the ignition tube (5) disposed external to the forming device (4); and, using an energy beam, igniting the explosive (7) within the ignition chamber (6) of the ignition tube (5); wherein a detonation front that is formed subsequent to igniting the explosive (7) propagates along the ignition tube (5) and into the forming device (4), to form the work piece (18) into the final shape as defined by the forming device (4).

By ignition by means of an energy beam, the explosion can be properly controlled in the die. The energy beam can be positioned relatively precisely at an ignition site, from which the explosion is to proceed. The amount of energy supplied to the explosive by the energy beam is also readily adjustable. In addition, the energy beam, and therefore the explosion, can also be precisely controlled in terms of time. Because of the aforementioned factors, the explosion and its course within the die can be readily controlled. Good predictability and reproduction accuracy of the forming result are thus possible.

In an advantageous embodiment of the invention, the energy beam can be generated by means of a laser. A laser beam can be well controlled with reference to time and local accuracy.

Advantageously, the energy beam can be guided from an energy source by means of a deflection device to at least one ignition site. Despite any fixed energy beam generator, the energy beam can be quickly and simply guided to the desired sites in space.

In one embodiment of the invention, the energy beam can be guided from an energy source by means of a mirror arrangement to at least one ignition site. The mirror arrangement is particularly suitable for energy beams in the form of laser beams and offers the aforementioned advantages of a deflection device.

In another embodiment of the invention the explosive can be ignited simultaneously at several sites of the device. For example, several detonation fronts can thus be generated within a die. Depending on the site at which the explosive is situated within the die, and the site at which it is ignited, the course of the detonation fronts can then be adjusted to the requirements of the forming process. As an alternative, in this method, explosives can also be ignited in several dies of the device simultaneously. Several even different work pieces can thus be formed almost simultaneously. This helps to shorten the cycle times.

Advantageously, the explosive can be ignited at several sites of the device with a time offset. If time-offset ignition occurs on an individual die of the device, several detonation fronts can be generated within a die on this account. The time offset then permits adjustment of the time response of the individual detonation fronts within the die. If time-offset ignition occurs on different dies of the device, the energy beam can ignite, for example, all dies of the device in succession. This helps to shorten cycle times, when parallel running forming processes overlap in time.

In principle, any combinations of simultaneous and time-offset ignition on one and/or several dies of the device are possible. Thus, the process can be well adapted to different production requirements. The basic idea of controlling propagation of detonation fronts via time-variable ignition at one or more sites of the die and thus influencing the forming result would also be attainable independently of the type of ignition, whether it is with an energy beam or otherwise.

In an advantageous embodiment of the invention, several detonation fronts can be generated within a die. Because of this, and especially because of time control of the course of the detonation fronts, a good forming result can be achieved.

Advantageously, at least one detonation front each within several dies of the device can be generated. The effectiveness of an ignition device with an energy beam can thus be increased.

In one embodiment of the invention, the energy beam can be introduced to an ignition tube of the device. Part of the die, namely, the ignition tube, can thus be adjusted to special requirements of the ignition and explosion process.

In another embodiment of the invention, the energy beam can enter the explosion space through a transparent medium. This can be readily accomplished technically and guarantees good impingement of the energy beam on the explosive. An energy beam generator can thus be positioned outside of the die and largely protected from the direct effects of the explosion in the interior of the die.

The task is further solved according to the invention by a device (1) for explosive forming of work pieces, comprising: an energy beam generator; and, a die (2) comprising a forming device (4) and an ignition tube (5), the forming device (4) defining a final shape of a work piece (18), and the ignition tube (5) being disposed external to the forming device (4) and having an ignition chamber (6) for being charged with an explosive;

wherein the work piece (18) is arranged within the forming device (4) and in fluid communication with the ignition chamber (6), such that a detonation front that is formed subsequent to igniting the explosive (7) propagates along the ignition tube (5), and into the forming device, to form the work piece (18) into the final shape as defined by the forming device (4).

The energy beam guarantees good ignition of the explosive. It is technically readily easily generated and can overcome distances quickly. Because of this, the explosive can be ignited with good time accuracy.

In an advantageous embodiment of the invention, the energy beam generator can include a laser. The laser represents a technically simple possibility for energy beam generation. It offers a readily bundled and therefore readily positionable energy or laser beam with adjustable amount of energy.

The die can advantageously have at least one introduction site transparent to the energy beam. The energy beam can thus penetrate the die and ignite the explosive contained in it. The energy beam generator can be arranged outside of the die and therefore largely protected from the direct effects of the explosion.

In one embodiment of the invention, the introduction site can have at least one transparent medium. This is particularly suited for laser beams. It guarantees good transmission of the energy beam with relatively low energy loss.

The transparent medium can advantageously include a glass insert. Glass is a suitable and easily processed material that offers the aforementioned advantages and is sufficiently resistant to the occurring explosion forces.

In another embodiment of the invention, the transparent medium can have a thickness in the range from 5 to 15 mm, preferably in the range from 7 to 12 mm, and especially in the range from 9 to 11 mm. This thickness has proven advantageous in practice. It guarantees sufficient stability, in order to withstand requirements by the explosion.

In an advantageous embodiment of the invention, the transparent medium can have an outside diameter of about 5 to 15 mm, preferably 7 to 12 mm, and especially 9 to 11 mm. It has been found that the outside diameter permits sufficiently good and rapid positioning of the energy beam with simultaneously good stability of the medium.

The transparent medium can advantageously be lens-like and shaped convex. The energy beam can thus be easily bundled.

In one embodiment of the invention, the transparent medium can have an approximately square cross-section. This guarantees good stability and good transmission properties.

The transparent medium can advantageously have an octagonal cross-section. Depending on the shape of the octagon, the energy beam can thus be bundled.

In another embodiment of the invention, the transparent medium can have a mount containing copper. It has been found that copper alloys, especially copper-beryllium alloys, offer sufficiently good stability and good sealing properties for this application.

The transparent medium can advantageously be arranged with a seal in the die that seals the explosion space from the surroundings. The surroundings are thus protected from the explosion and the explosion products.

In one embodiment of the invention, the die can have several introduction sites. The explosive can thus be ignited at several sites of the die simultaneously and/or with a time offset. For example, several detonation fronts can thus be generated in the die.

In an advantageous embodiment of the invention, several dies can be each provided with at least one introduction site. Because of this, several, optionally also different dies of the device can be ignited simultaneously or with a time offset. If the parallel forming processes overlap in time, the efficiency of the device can be increased.

At least one deflection device in the beam path of the energy beam generator can advantageously be provided, by means of which the energy beam can be directed toward at least one ignition site. Because of this, the energy beam can be simply, quickly and properly positioned.

In another embodiment of the invention, the deflection device can be a mirror arrangement. This is particularly suitable for laser beams and offers the aforementioned advantages of a deflection device.

In a particularly advantageous embodiment of the invention, the deflection device can have at least one mirror element partially transparent to the energy beam. The energy beam can thus be divided into several beams in simple fashion.

BRIEF DESCRIPTION OF THE DRAWINGS

Embodiments of the device according to the invention are described below with reference to the following drawings. In the drawings.

DETAILED DESCRIPTION OF THE PREFERRED EMBODIMENTS

Figure 1:
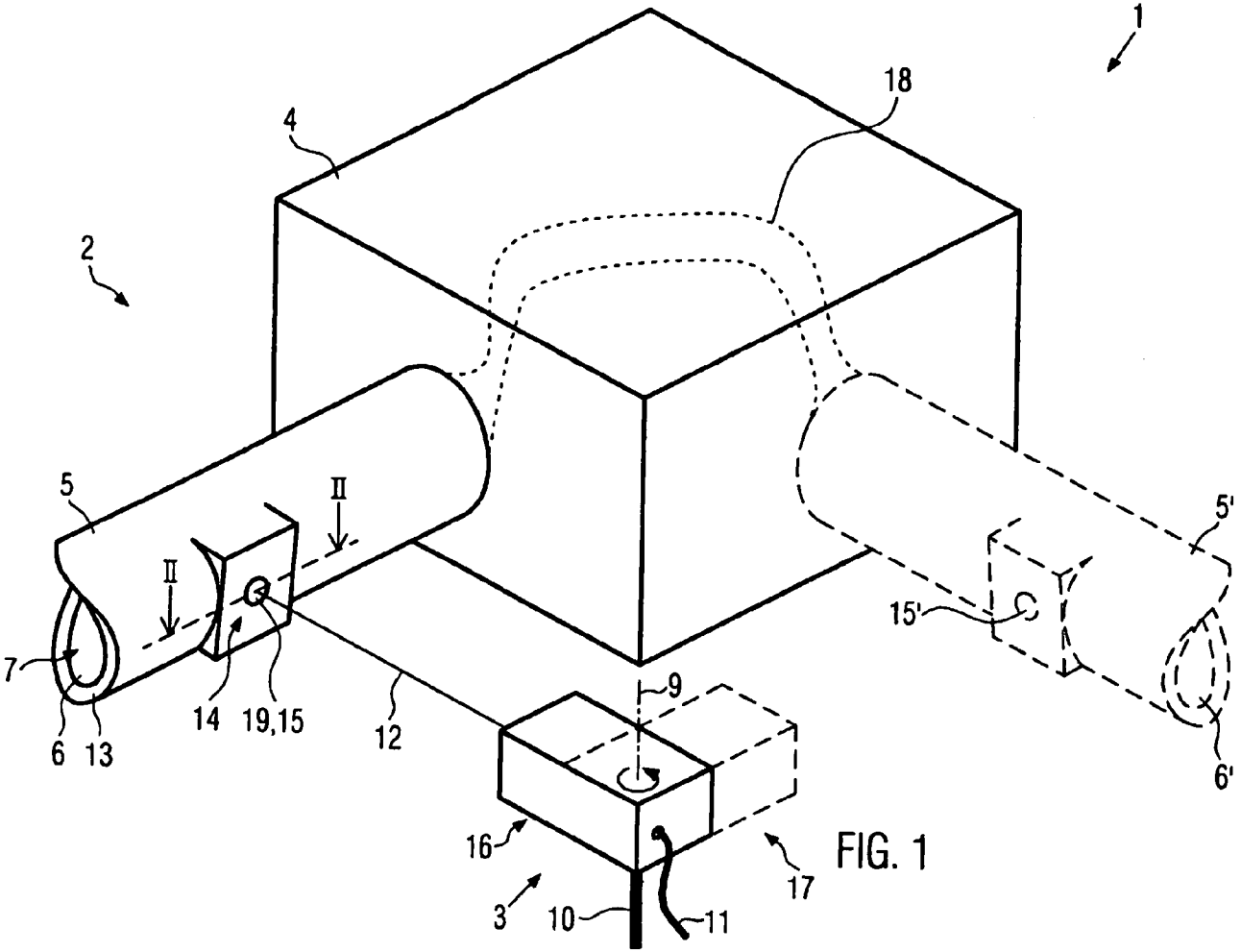
FIG. 1 shows a device for explosive forming according to a first embodiment of the invention.

FIG. 1 shows a device for explosive forming according to a first embodiment of the invention. The device 1 has a die 2 and an energy beam generator 3.

The die 2 in this embodiment of the invention is multipart and has a forming device 4 and an ignition tube 5. In the forming device 4, a work piece 18, indicated by a dotted line, is arranged here. In the interior of ignition tube 5, an ignition chamber 6 is provided. An explosive medium 7 is situated in it.

An explosive gas mixture, oxyhydrogen gas, is provided as explosive medium 7 in this embodiment, which can be introduced to ignition chamber 6 via a not illustrated connection. In other embodiments of the invention, however, other explosives can also be used in gaseous, liquid or solid form. The not illustrated connection is then designed according to the explosive as a gas, liquid or solid connection.

The energy beam generator 3 can optionally generate an energy beam 12 and, in this embodiment, is a laser device, which is mounted on a foot 10 to rotate around its vertical axis 9. It is supplied with energy via a line 11 and, as required, can generate an energy beam, in this case a laser beam 12.

The wall 13 of the ignition tube 5 has an introduction site 14 transparent to energy beam 12. In the region of introduction site 14, a transparent medium 15 is provided which is at least partially transparent to the energy beam 12. In this embodiment of the invention, the transparent medium 15 has a glass insert 19, which is shown more precisely in FIG. 2.

The laser device 3 is arranged, so that the laser beam 12 can penetrate through transparent medium 15 into ignition chamber 6 of ignition tube 5. The explosive medium 7 is ignited in the ignition chamber 6 on this account.

The die 2 of device 1 can optionally also have several introduction sites 14 for the energy beam 12 or ignition sites. The device 1, as shown with a dashed line here, can have an additional ignition tube 5', for example, which is designed in this embodiment similar to the first ignition tube 5. Accordingly, it also has an ignition chamber 6' filled with an ignition medium 7, a transparent medium 15' and a not illustrated connection.

By rotating the laser device 3 around the vertical axis 9, the laser device 3 can be brought from its first position 16, in which the laser beam 12 penetrates the ignition chamber 6 of the first ignition tube 5, into a second position 17, in which the laser beam 12 passes through the transparent medium 15' into ignition chamber 6' of the second ignition tube 5', as shown with a dashed line in FIG. 1. Thus, the ignition medium 7 in the ignition tubes 5, 5', for example, can be ignited in succession by laser device 3.

The work piece 18 in this case can be arranged, for example, between the two ignition tubes 5, 5', as shown in FIG. 1 by a dotted and dashed line.

Figure 2:
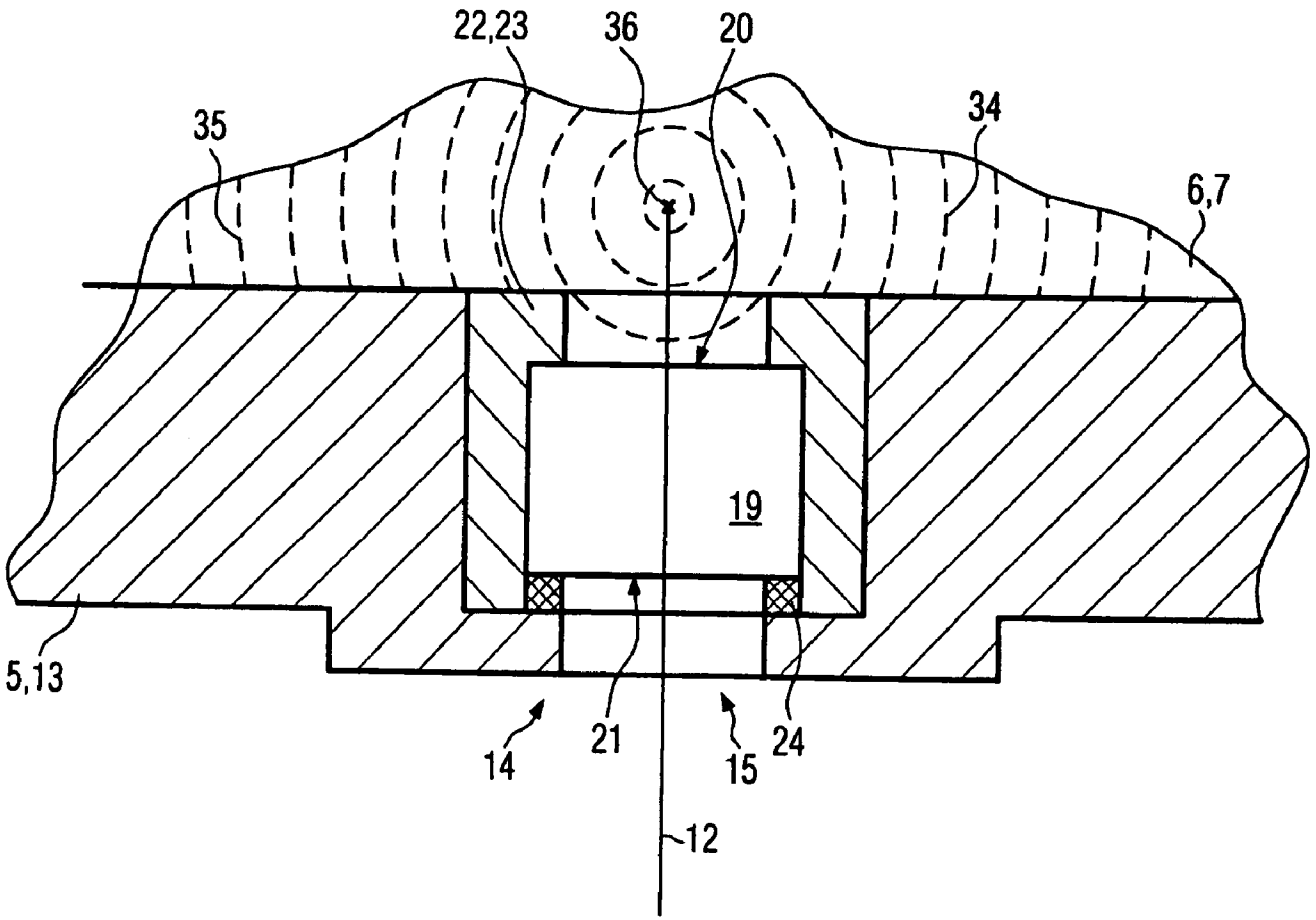
FIG. 2 shows section II-II through the die of the device from FIG. 1.

FIG. 2 shows a section II-II through the introduction site 14 of ignition tube 5 transparent to energy beam 12. The reference numbers used in FIG. 2 denote the same parts as in FIG. 1, so that the description of FIG. 1 is referred to in this respect.

The transparent medium 15 in this embodiment of the invention has a round glass insert 19 with a rectangular cross-section. The outside diameter and thickness of the glass insert are approximately of the same size. In this embodiment, the diameter, as well as the thickness of the glass insert 19, is 10 mm.

In other embodiments of the invention, this ratio, however, can vary significantly. The dimensions of the glass insert and its external shape can be adapted to the corresponding application. The cross-section through the glass element, for example, can also be octagonal. In addition, the surface 20 on the ignition chamber side and/or the surface 21 of the glass insert 19 opposite it can be curved, so that an approximately lens-like shape of the glass insert 19 is produced. The material of the insert 19 could also vary, depending on the application. If, as here, a laser is used as energy beam generator, pressure-resistant and heat-resistant, but nonetheless light-transparent plastics are conceivable.

The transparent medium 15 also has a mount 22, in which the glass insert 19 is arranged. The mount 22 in this embodiment of the invention is made from a copper-beryllium alloy. This is stable and withstands the dynamically, abruptly occurring, relatively high loads from the explosion. As an alternative, however, the mount 22 can also be made from a different copper alloy or any other material that withstands the high loads from the explosion. Its wall 23 has an L-shaped cross-section. The inside contour of mount 22 then corresponds approximately to the outside dimensions of glass insert 19.

The transparent medium 15 is arranged with a seal 24 in ignition tube 5, which seals the ignition chamber 6 in the interior of ignition tube 5 from the surroundings. The wall 13 of the ignition tube 5 and the mount 22 then form a press-fit.

Figure 3A:
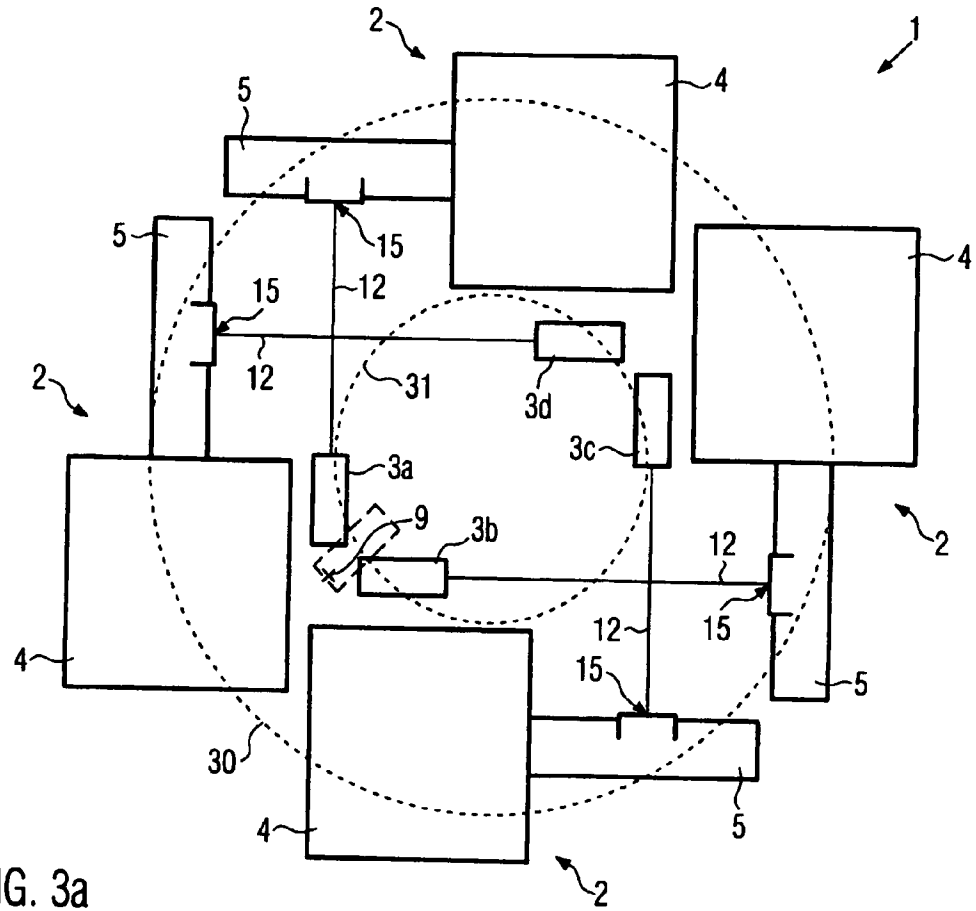
FIG. 3*a* shows a device according to a second embodiment of the invention.
Figure 3B:
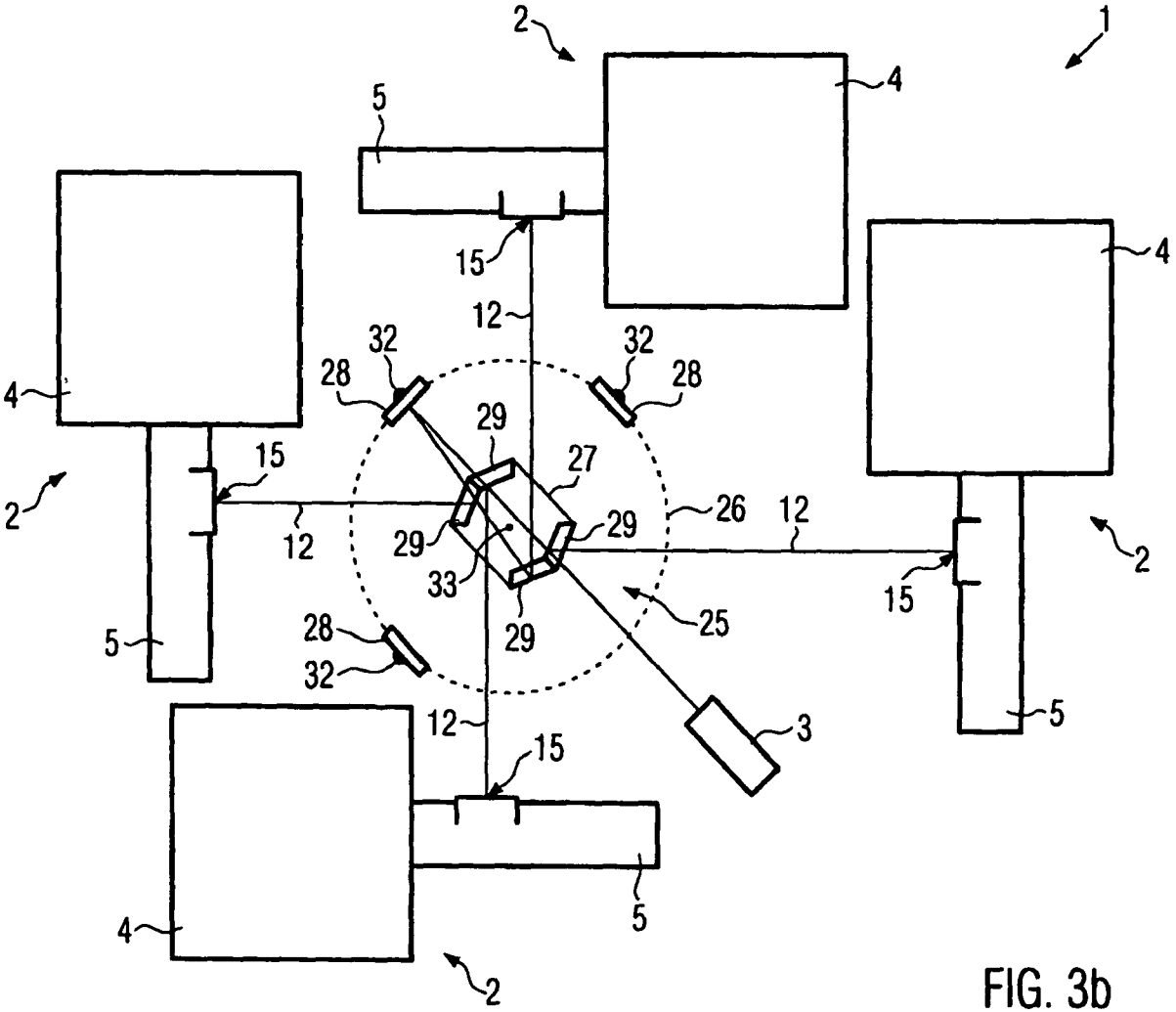
FIG. 3*b* shows a device according to a third embodiment of the invention.

Although the design of the device according to the invention is described here with reference to an individual die, the device 1 in other embodiments of the invention can also have several dies 2, as shown for example in FIGS. 3*a*, 3*b*.

FIGS. 3*a* and 3*b* show possible embodiments of a device according to the invention with several dies. The dies 2*a* to 2*d* then correspond to the die 2 shown and described in FIG. 1. FIGS. 3*a* and 3*b* show merely different possibilities of implementing such a device. The invention is in no way restricted to the embodiments depicted in these figures. Instead, the functional principles depicted in FIGS. 3*a* and 3*b* can also be combined with each other in any manner, depending on the application.

FIG. 3*a* shows a schematic view of a device according to a second embodiment of the invention. The reference numbers used in FIG. 3*a* denote the same parts as in FIGS. 1 and 2, so that the description of FIGS. 1 and 2 is referred to in this respect. The device 1 depicted in FIG. 3*a* has several dies 2 and several energy beam generators or laser devices 3. The design of these devices corresponds to the design shown in FIGS. 1 and 2 and repeatedly occurring same components are therefore provided with the suffix a, b, etc.

The device 1 here has four dies 2*a* to 2*d* and four laser devices 3*a* to 3*d*. The dies 2*a*to 2*d* are arranged approximately in a circle 30, indicated here with a dotted line. The laser devices 3*a* to 3*d* are also arranged approximately in a circle 31 that lies approximately concentric within circle 30. The laser devices 3*a* to 3*d* are arranged in relation to dies 2*a* to 2*d*, so that one of the laser beams 12*a* to 12*d* penetrates through transparent medium 15 into one of the dies 2*a* to 2*d* in ignition chamber 6*a* to 6*d* and can ignite the explosive medium 7 there.

As an alternative, in the arrangement chosen in FIG. 3*a*, the two laser devices 3*a* and 3*b* can also be replaced by a single laser device, shown here with a dash-dot line, which is positioned similar to FIG. 1 rotatable around its vertical axis 9. By rotation around axis 9, this laser device could assume both the position of laser device 3*a* and the position of laser device 3*b*. The same applies for laser devices 3*c* and 3*d*, which are similarly also replaceable by a single laser device rotatable around vertical axis 9.

FIG. 3*b* shows a schematic view of a device according to a third embodiment of the invention. The reference numbers used in FIGS. 1 and 2 denote the same parts as in FIG. 3*b*, so that the description of FIGS. 1 and 2 is referred to in this respect. The device 1 depicted in FIG. 3*a* has several dies 2 and energy or laser beam generators 3. The design of the individual dies 2*a* to 2*d* and of the energy beam generator 3 corresponds to the die 2 and energy beam generator 3 depicted in FIGS. 1 and 2.

The device 1 here additionally has a deflection device 25 for the energy or laser beam 12. In this case, the deflection device 25 is a mirror arrangement. It has a central polyhedral element 27 and several, in this case three, additional minor elements 28. The surfaces of the central element 27 also have mirrors 29. In this embodiment of the invention, four surfaces of the central element 27 are provided with mirrors 29. At least some of the mirrors 29 can then be partially transparent to the energy or laser beam 12. Here, three of the mirrors 29 are partially transparent. A partially transparent mirror 29 reflects a predetermined part of the laser light or beam 12 impinging on it. The rest of the laser beam 12 passes almost unaltered through the partially transparent mirror. The laser beam 12 emitted from the laser device 3 can thus be split.

The central polyhedral element 27 is rotatable around its vertical axis 33, arranged approximately in the center of a circle 26, indicated with dotted lines, whereas the mirror elements 28 are arranged approximately on circle 26. The mirror elements 28 are also mounted to rotate around their corresponding vertical axis 32. The individual parts 27, 28, 29 of mirror arrangement 25 are then arranged in relation to the laser device 3 and dies 2*a* to 2*d*, so that the laser beam 12, according to the alignment of mirrors 28 and 29, is alternately passed through the transparent medium 15 of one of the dies 2*a* to 2*d* to an ignition site in the corresponding ignition chamber 6*a* to 6*d*.

Although the deflection of mirror arrangement 25 is shown and described here with a central polyhedral element 27 and several minor elements 28, the deflection arrangement 25 can be designed in other embodiments of the invention completely differently. The number and position of the mirror elements 28 can vary, depending on the application. The individual elements 27, 28, 29 of the deflection arrangement 25 need not necessarily be arranged on or within a circle 26, as shown here. The central element 27, which is polyhedral here, can also have a different shape, for example, disk-like or be entirely left out. In addition, the individual elements 27, 28, 29 of the deflection arrangement 25 can also be tiltable relative to each other. For example, the height of the laser beam 12 above the substrate, on which the device stands, can thus be varied. For this purpose, the individual elements 27, 28, 29 of deflection arrangement 25 can be provided with rotary and/or ball joints. Under practical conditions, other embodiments of the deflection device 25 are also conceivable. The laser beam 12, for example, can also be guided by means of one or more glass fiber elements to one or more introduction sites 14 in a die 2. The arrangement and design of the individual dies 2*a* to 2*d* can also deviate from that shown here and vary, depending on the application.

The method of function of the embodiments depicted in FIGS. 1 to 3*b* is explained below.

The method of function is initially described with reference to FIGS. 1 and 2 for a device with a die and an energy beam generator. The energy beam generator or laser device 3 of device 1 is positioned in FIG. 1, so that the laser beam 12 can pass through the transparent medium 15 of wall 13 of ignition tube 5 into ignition chamber 6.

The die 2, in this case, the ignition tube 5 of die 2, is then filled with explosives 7. For this purpose, an explosive, for example, oxyhydrogen gas, is fed into the ignition chamber 6 of ignition tube 5 via the not illustrated connection. When a predetermined amount of explosive 7 has collected in ignition chamber 5, the not illustrated connection is closed.

To ignite the explosive 7, an energy beam, in this case a laser beam 12, is generated in the energy beam generator or laser device 3. The laser beam 12 emerging from the laser device 3 impinges on transparent medium 15, passes through it and encounters the explosive 7 in ignition chamber 6.

FIG. 2 shows the process more precisely. The laser beam 12 encounters the outer surface 21 of glass insert 19 of transparent medium 15. Because of the condition and shape of glass insert 19, the laser beam passes through glass insert 19 largely unhampered and without high deflection and impinges on the surface 20 on the ignition chamber side again from glass insert 19, and therefore enters the ignition chamber 6 of ignition tube 5. The laser beam 12 there encounters the explosive 7 and ignites it in the area of ignition site 36.

Depending on the shape of glass insert 19, the laser beam 12 can be varied. With a lens-like glass insert 19 with a curved outer surface 21 and/or curved surface 20 in the ignition chamber side, the laser beam 12 can be bundled, in the case of a convex arch, and thus focused onto a certain ignition site. With a concave arch, the laser beam 12, on the other hand, can be spread out. If the surfaces 20, 21 are sloped relative to each other, as is the case in a polyhedral or octagonal cross-section, the propagation direction of laser beam 12 can be deflected.

The resulting explosion of explosive 7 develops, within a short time, a relatively large pressure change, which exerts relatively large forces on ignition tube 5 and transparent medium 15, as well as a relatively large temperature increase. The interface of the transparent medium with ignition tube 5 is also sealed during this abrupt dynamic loading by seal 24. The interface between glass insert 19 and mount 22 is also sealed by seal 24. In the first place, this guarantees a good pressure buildup in ignition tube 5, and, in the second place, protects the surroundings outside of die 2 from the direct effects of the explosion, like pressure and temperature changes, as well as possible harmful explosion products, for example, exhausts.

The pressure or detonation front forming during the explosion propagates along the ignition tube 5, enters work piece 18 and forces it into forming device 4. The detonation front propagates essentially from ignition site 36 spherically. In this case, this means that a part 34 of the detonation front moves in the direction of work piece 18, starting from ignition site 36. Another part 35 of the detonation front, on the other hand, moves away from the work piece 18, as shown in FIG. 2. Depending on the design of ignition tube 5 and the position of the introduction 14 and ignition site 36, the course of the second part 35 of the detonation front can be controlled.

If the ignition tube 5 is designed so that this part of the detonation front is reflected when it has reached the end of the ignition tube 5, two detonation front parts 34, 35 can be generated, which move over the work piece 18 offset in time. The time offset of the two detonation front parts can be controlled by the position of ignition site 36 and the introduction site 14 and the shape of ignition tube 5.

If, on the other hand, the die 2 has several introduction 14 and ignition sites 36, as indicated with the dashed line in FIG. 1, ignition of the explosive 7 can occur at several sites of the die. For this purpose, the laser device 3, after it has released a first laser beam 12 into ignition chamber 6 of the first ignition tube 5 and has therefore ignited the explosive 7 in the first ignition tube 5, is rotated around the vertical axis 9 from a first position 16 to its second position 17. Another laser beam 12 is then generated, which passes through transparent medium 15' of the second ignition tube 5' into the second ignition chamber 6'. There, it encounters the explosive 7 and ignites it. Several, in this case two, detonation fronts can thus be generated within one die.

In addition to time control of the two laser pulses, the course of the two detonation fronts can be influenced, for example, by appropriate arrangement of the introduction 14 or ignition site 36. In the embodiment of the invention depicted in FIG. 1, two detonation fronts are formed, which move one on the other and meet at a certain site in die 2.

If several ignition sites in a die 2, as in FIG. 1, or also several dies 2*a* to 2*d*, as in FIGS. 3*a* and 3*b*, are to be simultaneously ignited, one can alternately work with several laser devices 3 or with only one laser device 3 and a deflection device 25. The functional principle of these two embodiments of the invention is illustrated in FIGS. 3*a* and 3*b*. Depending on the application, a combination of both possibilities, i.e., several laser devices 3 and at least one deflection arrangement 25, also works.

The arrangement of dies 2*a* to 2*d* and laser devices 3*a* to 3*d* in FIGS. 3*a* and 3*b* permits both simultaneous and time-offset ignition of the explosive in the individual dies 2*a* to 2*d*.

For simultaneous ignition, in FIG. 3*a* laser beams 12*a* to 12*d* are simultaneously generated in all four laser devices 3*a* to 3*d*, which approximately simultaneously penetrate through the transparent media 15*a* to 15*d* into ignition chambers 6*a* to 6*d* of the corresponding dies 2*a* to 2*d* and ignite the explosive 7 there.

In FIG. 3*b*, on the other hand, only one laser beam 12 is generated, which is divided and deflected via the deflection or mirror arrangement 25, so that it penetrates approximately simultaneously the transparent media 15*a* to 15*d* into ignition tubes 5*a* to 5*d* of the corresponding dies 2*a* to 2*d* and ignites the explosive 7 there.

At approximately the same time, at least one detonation front, as already explained with reference to FIG. 1, is formed in each of the dies 2*a* to 2*d*.

For time-offset ignition, a laser beam 12*a* to 12*d* is generated in FIG. 3*a* in the laser devices 3*a* to 3*d* with time offset, for example, in succession. These then enter, in succession, the ignition chamber 6*a* to 6*d* of the corresponding dies 2*a* to 2*d* and ignite the explosive 7*a* to 7*d* in dies 2*a* to 2*d* in succession. Initially, explosive 7*a* in die 2*a*, then explosive 7*b* in die 2*b*, etc., are ignited. The time offset between generation of laser beams 12*a* to 12*d* is then optionally selectable. For example, laser beams 12*a* to 12*d* can be generated simultaneously, whereas laser beams 12*c* and 12*d* can be offset in time. In principle, any combinations are conceivable.

There are several possibilities in FIG. 3*b* of igniting the explosive 7 in dies 2*a* to 2*d*with a time offset. In the first place, the laser device 3 can generate several laser beams 12 in succession. Between generation of the individual laser beams, the position of the individual elements 27, 28, 29 of the deflection arrangement is changed relative to each other and/or the position of laser device 3, so that the laser beam 12 penetrates, in succession, the transparent medium 15*a* to 15*d* of another die 2*a* to 2*d*, and thus ignites the explosive 7*a* to 7*d*.

As an alternative, the laser device 3 can generate continuous laser beam 12, which is deflected by means of the deflection arrangement 25 into the ignition chamber 6*a* of the first die 2*a* and ignites the explosive there. If the explosive in die 2*b* is now to be ignited, the position of the individual elements 27, 28, 29 of the deflection arrangement 25 is changed relative to each other and/or the position of the laser device 3, so that the laser beam 12 passes through the transparent medium 15*b* into ignition chamber 6*b*. The procedure is similar for ignition of the explosive in dies 2*c* and 2*d*.

If several, for example, two dies are to be ignited simultaneously, partially transparent deflection elements, in this case, partially transparent mirror elements, can be used for energy beam 12. These permit only part of the laser beam 12 to be deflected, whereas the rest of the laser beam retains its original direction. Thus, the laser beam 12 can be directed toward an ignition site, for example, in die 2*a*, in order to ignite the explosive 7 there. By means of a partially transparent mirror element, part of the laser beam 12 can simultaneously be directed toward an additional ignition site, for example, in die 2*b*, and also ignite the explosive there.

What is claimed is:

1. A method for explosive forming of work pieces comprising: arranging a work piece (18) within a forming device (4) of a die (2), the forming device (4) defining a final shape of the work piece (18);

charging an ignition chamber (6) of an ignition tube (5) of the die (2) with an explosive (7), the ignition tube (5) disposed external to the forming device (4) and wherein the ignition tube includes walls defining a passageway extending from the ignition chamber; and, propagating an energy beam from a location external to the ignition chamber (6), through a transparent solid medium that is disposed within the passageway and sealingly engages the ignition tube (5), and to an ignition site (36) within the ignition chamber (6), thereby igniting the explosive (7) within the ignition chamber (6) of the ignition tube (5);

wherein a detonation front that is formed subsequent to igniting the explosive (7) propagates along the ignition tube (5) and into the forming device (4), to form the work piece (18) into the final shape as defined by the forming device (4).

2. The method according to claim 1, wherein the energy beam (12) is generated using a laser device (3).

3. The method according to claim 2, wherein the energy beam (12) is guided from the laser device (3) via a deflection arrangement (25) to the ignition site (36) within the ignition chamber (6).

4. The method according to claim 3, wherein the deflection arrangement (25) comprises a mirror arrangement.

5. The method according to claim 2, wherein the explosive (7) comprises plural explosives and wherein the plural explosives are ignited simultaneously at a plurality of different ignition sites (36).

6. The method according to claim 2, wherein the explosive (7) comprises plural explosives and wherein the plural explosives are ignited at a plurality of different ignition sites (36) with a time offset.

7. The method according to claim 2, wherein a plurality of detonation fronts (34, 35) is generated subsequent to igniting the explosive.

8. The method according to claim 2, wherein at least one detonation front (34) is generated within each die of a plurality of dies (2*a* to 2*d*).

9. A device (1) for explosive forming of work pieces, comprising: an energy beam generator; and, a die (2) comprising a forming device (4) and an ignition tube (5), the forming device (4) defining a final shape of a work piece (18), and the ignition tube (5) being disposed external to the forming device (4) and having an ignition chamber (6) for being charged with an explosive (7), the ignition tube (5) having walls defining a passageway extending from said ignition chamber and adjacent to an ignition site (36) within the ignition chamber (6) and a transparent solid medium (15) and a seal (24), disposed within said passageway, said transparent solid medium capable of supporting optical communication between the energy beam generator and the ignition site (36) and wherein said seal and said transparent medium seal the ignition chamber (6) from external surroundings;

wherein the work piece (18) is arranged within the forming device (4) and in fluid communication with the ignition chamber (6), such that a detonation front that is formed subsequent to igniting the explosive (7) propagates along the ignition tube (5), and into the forming device, to form the work piece (18) into the final shape as defined by the forming device (4).

10. The device (1) according to claim 9, wherein the energy beam generator comprises a laser device (3).

11. The device (1) according to claim 10, wherein the transparent medium (15) comprises a glass insert (19).

12. The device (1) according to claim 11, wherein the glass insert (19) has a thickness in the range from 5 to 15 mm.

13. The device (1) according to claim 12, wherein the glass insert (19) has a thickness in the range from 7 to 12 mm.

14. The device (1) according to claim 13, wherein the glass insert (19) has a thickness in the range from 9 to 11 mm.

15. The device (1) according to claim 11, wherein the glass insert (19) has an outside diameter of about 5 to 15 mm.

16. The device (1) according to claim 15, wherein the glass insert (19) has an outside diameter of about 7 to 12 mm.

17. The device (1) according to claim 16, wherein the glass insert (19) has an outside diameter of about 9 to 11 mm.

18. The device (1) according to claim 10, wherein the transparent medium (15) is lens-like and convex.

19. The device (1) according to claim 10, wherein the transparent medium (15) has an approximately square cross-section.

20. The device (1) according to claim 10, wherein the transparent medium (15) has an approximately octagonal cross-section.

21. The device (1) according to claim 10, wherein the transparent medium (15) comprises a mount (22) containing copper.

22. The device (1) according to claim 9, wherein said passageway, said transparent solid medium and said seal cooperatively form an introduction site and the die (2) comprises a plurality of introduction sites (14).

23. The device (1) according to claim 9, wherein said passageway, said transparent solid medium and said seal cooperatively form an introduction site and a plurality of dies (2) are provided with at least one introduction site (14) each.

24. The device (1) according to claim 22, wherein a plurality of dies (2) are provided with at least one introduction site (14) each.

25. The device (1) according to claim 9, wherein at least one deflection arrangement (25) is provided in a beam path of the energy beam generator (3), for directing the energy beam (12) to the ignition site (36).

26. The device (1) according to claim 25, wherein the deflection arrangement (25) is a mirror arrangement.

27. The device (1) according to claim 25, wherein the deflection arrangement (25) comprises at least one mirror element (29), partially transparent to the energy beam (12).

28. A method for explosive forming of tubular work pieces, comprising:

arranging a tubular work piece (18) within a forming device (4) of a die (2), the forming device (4) defining a final shape of the work piece (18);

charging an ignition chamber (6) of an ignition tube (5) of the die (2) with an explosive, the ignition tube (5) disposed external to the forming device (4), and wherein the ignition chamber includes walls defining a passageway extending from the ignition chamber and wherein the ignition chamber (6) is in fluid communication with an interior volume of the work piece (18); and, directing an energy beam (12) from outside of the ignition tube (5), through a transparent solid medium (15) that is disposed in the passageway at an introduction site (14) of the ignition tube (5) and that sealingly engaging the ignition tube (5), and into the ignition chamber (6), thereby igniting the explosive;

wherein a detonation front that is formed subsequent to igniting the explosive propagates along the ignition tube (5) into the interior volume of the work piece (18), and forms the work piece (18) to conform with the final shape as defined by the forming device (4).

29. A device (1) for explosive forming of tubular work pieces, comprising:

an energy beam generator; and, a die (2) comprising a forming device (4) and an ignition tube (5) having walls defining a passageway, the forming device (4) defining a final shape of a work piece (18), and the ignition tube (5) being disposed external to the forming device (4) and having an ignition chamber (6) adjacent to an introduction site (14), the introduction site (14) comprising said passageway and a transparent solid medium (15) and a seal (24), the transparent solid medium for supporting propagation of an energy beam (12) from the energy beam generator to an ignition site (36) within the ignition chamber (6) for igniting an explosive (7) that is contained within the ignition chamber (36), the seal (24) preventing fluid communication between the ignition chamber (6) and external surroundings, wherein the work piece (18) is arranged within the forming device (4) and in fluid communication with the ignition chamber (6), such that a detonation front that is formed subsequent to igniting the explosive (7) propagates along the ignition tube (5) into an interior volume of the tubular work piece (18), and forms the work piece (18) to conform with the final shape as defined by the forming device (4).

30. A device (1) for explosive forming of tubular work pieces, comprising: an energy beam generator; and, a die (2) comprising:

a forming device (4) defining a final shape of a work piece (18); and an ignition tube (5), the ignition tube (5) disposed external to the forming device (4) and defining an ignition chamber (6) that is in fluid communication with the forming device (4), the ignition tube (5) having walls defining a passageway and including an introduction site (14) for propagating an energy beam (12) from the energy beam generator to an ignition site (36) within the ignition chamber (6) for igniting an explosive (7) contained within the ignition chamber (6), the introduction site (14) including, the passageway, a transparent medium (15) in the form of a glass insert (19) that is mounted in a mount (22) within the passageway, there being a seal (24) disposed between the glass insert (19) and a surface of the ignition tube (5) for sealing the ignition chamber (6) of ignition tube (5) from external surroundings, the ignition tube (5) including a connection (8) for introducing a gaseous flow of the explosive (7) into the ignition chamber (6), wherein the work piece (18) is arranged within the forming device (4) and in fluid communication with the ignition chamber (6), such that a detonation front that is formed subsequent to igniting the explosive (7) propagates along the ignition tube (5) into an interior volume of the tubular work piece (18), and forms the work piece (18) to conform with the final shape as defined by the forming device (4).

31. A method according to claim 1, wherein charging the ignition chamber (6) comprises providing a flow of an explosive gas mixture into the ignition chamber (6) via a connection (8) of the ignition tube (5).

32. A method according to claim 31, wherein the explosive gas mixture is oxyhydrogen gas.

33. A device according to claim 9, wherein the ignition tube (5) comprises a connection (8) in fluid communication with a source of an explosive gas, for providing a flow of the explosive gas from the source into the ignition chamber (6).

34. A method according to claim 28, wherein charging the ignition chamber (6) comprises providing a flow of an explosive gas mixture into the ignition chamber (6) via a connection (8) of the ignition tube (5).

35. A method according to claim 34, wherein the explosive gas mixture is oxyhydrogen gas.

36. A device according to claim 29, wherein the ignition tube (5) comprises a connection in fluid communication with a source of an explosive gas, for providing a flow of the explosive gas from the source into the ignition chamber (6).

* * * * *